United States Patent [19]

Aoki et al.

[11] Patent Number: 4,696,868

[45] Date of Patent: Sep. 29, 1987

[54] INTENSIFYING SCREENS

[75] Inventors: Yuji Aoki, Odawara; Hidenaga Horiuchi; Akio Umemoto, both of Oi; Norio Miura, Isehara, all of Japan

[73] Assignee: Kasei Optonix, Ltd., Tokyo, Japan

[21] Appl. No.: 912,515

[22] Filed: Sep. 29, 1986

Related U.S. Application Data

[63] Continuation-in-part of Ser. No. 784,996, Oct. 7, 1985.

[30] Foreign Application Priority Data

Oct. 17, 1984 [JP] Japan ..... 59-216435

[51] Int. Cl.[4] ..... H05B 33/00

[52] U.S. Cl. ..... 428/690; 250/484.1; 250/486.1; 428/691

[58] Field of Search ..... 250/484.1, 486.1; 428/690, 691, 917

[56] References Cited

U.S. PATENT DOCUMENTS

| | | | |
|---|---|---|---|
| 3,725,704 | 0/0000 | Buchanan . | |
| 4,051,374 | 9/1977 | Drexhage et al. | 250/486.1 X |
| 4,054,799 | 10/1977 | Wolfe et al. | 250/486.1 |
| 4,362,944 | 0/0000 | Suzuki et al. . | |
| 4,368,390 | 0/0000 | Fuji Photo . | |
| 4,394,581 | 7/1983 | Yakahashi et al. | 250/486.1 X |

FOREIGN PATENT DOCUMENTS

| | | | |
|---|---|---|---|
| 0021174 | of 0000 | European Pat. Off. . | |
| 0088820 | 9/1983 | European Pat. Off. . | |
| 0092240 | 10/1983 | European Pat. Off. . | |
| 0102010 | 3/1984 | European Pat. Off. . | |
| 0158787 | 10/1985 | European Pat. Off. . | |
| 3031267 | of 0000 | Fed. Rep. of Germany . | |
| 2351436 | of 0000 | France . | |
| 2167535 | of 0000 | France . | |
| 2205683 | of 0000 | France . | |
| 2167011 | of 0000 | France . | |
| 2495818 | 6/1982 | France . | |
| 0118880 | 9/1984 | Japan | 250/286.1 |

OTHER PUBLICATIONS

Research Disclosure, No. 165, Jan. 1978, p. 17, Chemical Abstracts, vol. 86, No. 18, May 2, 1977, p. 745.

*Primary Examiner*—Nancy A. Swisher
*Attorney, Agent, or Firm*—Oblon, Fisher, Spivak, McClelland, & Maier

[57] ABSTRACT

An intensifying screen comprising: a support, a fluorescent layer on the support and a protective layer on the fluorescent layer, wherein the fluorescent layer is composed essentially of a blue emitting phosphor selected from the group consisting of (1) a $M^{II}WO_4$ phosphor wherein $M^{II}$ is at least one of Mg, Ca, Zn and Cd, (2) a $CaWO_4$ phosphor, (3) a $BaSO_4$:Pb phosphor, (4) a $BaSO_4:Eu^{2+}$ phosphor, (5) a $(Ba, Sr)SO_4:Eu^{2+}$ phosphor, (6) a $MeF_2.pMe'X_2.qKX'.rMe''SO_4:mEu^{2+}, nTb^{3+}$ phosphor, wherein Me is at least one of Mg, Ca, Sr and Ba, each of Me' and Me'' is at least one of Ca, Sr and Ba, each of X and X' is at least one of Cl and Br, and p, q, r, m and n are numbers which satisfy the conditions of $0.80 \leqq p \leqq 1.5$, $0 \leqq q \leqq 2.0$, $0 \leqq r \leqq 1.0$, $0.001 \leqq m \leqq 0.10$ and $0 \leqq n \leqq 0.05$, respectively, provided $q+r \neq 0$, (7) a LnOX:Tm phosphor wherein Ln is La or Gd, and X is Cl or Br, (8) a $Ln(Ta_{1-x}, Nb_x)O_4$:Tm phosphor wherein Ln is at least one of La, Y Gd and Lu, and $0 \leqq x \leqq 0.3$, (9) a $Y_2O_2S$:Tb phosphor, (10) a CsI:Na phosphor, (11) a CsI:Tl phosphor, (12) a NaI phosphor, (13) a ZnS:Ag phosphor and (14) a $HfP_2O_7$: Cu phosphor, and wherein at least one of the fluorescent and protective layers is colored with a colorant which has a main absorption peak at a wavelength in the region of 400 to 600 nm.

9 Claims, 2 Drawing Figures

INTENSIFYING SCREENS

This is a continuation-in-part of application Ser. No. 784,996, filed Oct. 7, 1985.

BACKGROUND OF THE INVENTION

1. FIELD OF THE INVENTION

The present invention relates to intensifying screens wherein at least one of the fluorescent and protective layers is colored, whereby the photographic image quality, particularly sharpness, is improved.

2. DESCRIPTION OF THE PRIOR ART

As is well known, the intensifying screen is in face contact with an X-ray film to improve the speed in a photographic system in various fields including radiography for medical purposes such as X-ray radiography used for medical diagnosis or radiography for industrial purposes such as non-destructive inspection of materials. Basically, the intensifying screen comprises a support such as a paper or plastic sheet, and a fluorescent layer formed on one side of the support.

The fluorescent layer is usually composed of a binder resin and a phosphor which is capable of emitting a near-ultraviolet, blue or green color of high luminance when stimulated by radiation. And the surface of the fluorescent layer (the surface opposite to the support) is usually protected by a transparent protective layer such as a polyethylene terephthalate film, a cellulose acetate film or a polymethacrylate film to prevent the abrasion or scratching of the phosphor layer.

It is important for an intensifying screen not only to have a high speed but also is capable of providing a good photographic image quality. For the improvement of the photographic image quality, particularly the sharpness, of the intensifying screen, various methods have been studied including a method in which phosphor particles in the fluorescent layer are arranged with a certain specificity with respect to the particle sizes (U.S. Pat. No. 4,039,840), and a method in which the fluorescent layer is colored (Japanese Unexamined Patent Publication No. 70787/1979).

SUMMARY OF THE INVENTION

It is an object of the present invention to provide an intensifying screen having an excellent photographic image quality, particularly excellent sharpness, which is capable of improving the diagnostic ability in the medical radiography.

Paying a particularly attention to the fact that the photographic image quality of an intensifying screen is improved by coloring at least one of the fluorescent and protective layers of the intensifying screen, the present inventors have conducted extensive researches on the relation between the types of the colorants and the sharpness of the intensifying screens thereby obtained with respect to intensifying screens which are used in combination with regular films and in which phosphors capable of emitting near-ultraviolet or blue colors under excitation of radiation, such as a $CaWO_4$ phosphor, are used for the fluorescent layers, and have finally found that the above object can be attained by coloring at least one of the fluorescent and protective layers of an intensifying screen with a colorant which absorbs a light of a certain specific wave length. The present invention is based on this discovery. In this specification, phosphors which have the main peaks of the emission spectra in a near-ultraviolet or blue region and which are capable of emitting near-ultraviolet or blue colors, will be referred to generally as "blue emitting phosphors".

Thus, the present invention provides an intensifying screen comprising a support, a fluorescent layer on the support and a protective layer on the fluorescent layer, wherein the fluorescent layer is composed essentially of a blue emitting phosphor, and at least one of the fluorescent and protective layers is colored with a colorant having the main peak of the absorption spectrum in a wave length region of from 400 to 600 nm.

Now, the present invention will be described in detail with reference to the preferred embodiments.

BRIEF DESCRIPTION OF THE DRAWINGS

In the accompanying drawings.

DETAILED DESCRIPTION OF THE PREFERRED EMBODIMENTS

Figure 1:
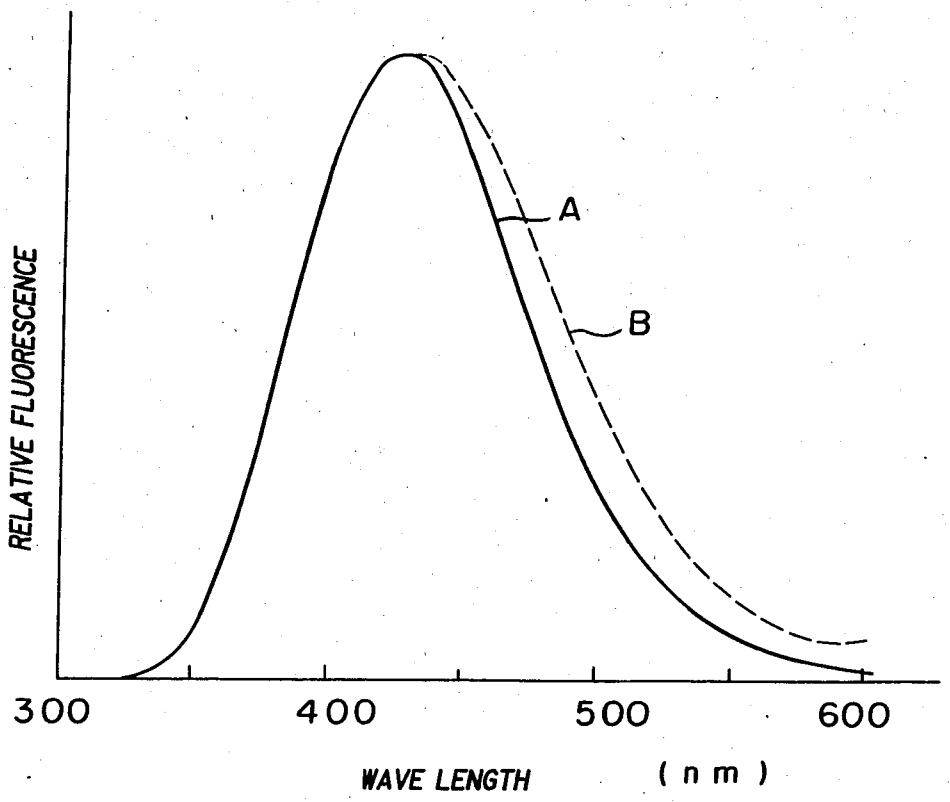
FIG. 1 is a graph illustrating the emission spectra of an intensifying screen of the present invention and a conventional intensifying screen.

The intensifying screen of the present invention can be prepared in the following manner.

Firstly, blue emitting phosphor particles capable of emitting a blue color under excitation of radiation and a colorant are mixed with a binder resin such as nitrocellulose, and a proper amount of a solvent is added thereto to obtain a coating dispersion of the phosphor having the optimum viscosity. This coating dispersion of the phosphor is applied onto a support made of e.g. paper or plastic by means of a roll coater or a knife coater, to form a fluorescent layer. In a case where a light reflection layer, a light absorption layer or a metal layer is to be provided between the support and the fluorescent layer, such a light reflection layer, a light absorption layer or a metal layer is preliminarily formed on the support, and then the coating dispersion of the phosphor is applied thereon, followed by drying to form a fluorescent layer. Then, a colored protective layer is formed on the fluorescent layer to obtain an intensifying screen. For the formation of the colored protective layer, there may be employed a method in which a proper amount of a solvent is added to a resin such as polymethacrylate or cellulose acetate containing a colorant, to obtain the optimum viscosity, and the liquid thereby obtained is coated on the fluorescent layer and dried, or a method in which a thin transparent film such as a polyethylene terephthalate film with its one side or each side colored with a colorant, is laminated onto the fluorescent layer.

In the case where the surface of the fluorescent layer composed of blue emitting phosphor particles, is made mainly of a colored binder resin formed by controlling the viscosity of the coating dispersion of the phosphor for the formation of the fluorescent layer or by controlling the drying condition of the coating dispersion applied onto the support and serving as a protective layer, it is not necessary to provide a further protective layer on the fluorescent layer. In the intensifying screen of the present invention, it is not essential that both the fluorescent and protective layers are colored. Therefore, in a case where only one of the fluorescent and protective layers is colored, the above colorant is not used for the formation of the other layer.

As the phosphor to be used for the fluorescent layer of the intensifying screen of the present invention, there may be mentioned phosphors which have the main peaks of the emission spectra in a near-ultraviolet or blue region and which are capable of emitting near-ultraviolet or blue colors under excitation of radiation, such as a $M^{II}WO_4$ phosphor (wherein $M^{II}$ is at least one of Mg, Ca, Zn and Cd), a $CaWO_4$:Pb phosphor, a $BaSO_4$:Pb phosphor, a $BaSO_4:Eu^{2+}$ phosphor, a $(Ba, Sr)SO_4:Eu^{2+}$ phosphor, a $(Ba, Sr)_3(PO_4)_2:Eu^{2+}$ phosphor, a $MeF_2.pMe'X_2.qKX'.rMe''SO_4:mEu^{2+}, nTb^{3+}$ phosphor (wherein Me is at least one of Mg, Ca, Sr and Ba, each of Me' and Me'' is at least one of Ca, Sr and Ba, each of X and X' is at least one of Cl and Br, and p, q, r, m and n are numbers which satisfy the conditions of $0.80 \leqq p \leqq 1.5$, $0 \leqq q \leqq 2.0$, preferably $0.10 \leqq q \leqq 1.20$, $0 \leqq r \leqq 1.0$, preferably $0.01 \leqq r \leqq 0.40$, $0.001 \leqq m \leqq 0.10$ and $0 \leqq n \leqq 0.05$, respectively, provided $q+r \neq 0$), a LnOX:Tm phosphor (wherein Ln is La or Gd, and X is Cl or Br), a $Ln(Ta_{1-x}, Nb_x)O_4$:Tm phosphor (wherein Ln is at least one of La, Y, Gd and Lu, and $0 \leqq x \leqq 0.3$), a CsI:Na phosphor, a CsI:Tl phosphor, a NaI phosphor, a ZnS:Ag phosphor and a $HfP_2O_7$:Cu phosphor. Among these blue emitting phosphors, a $CaWO_4$ phosphor, a LnOX:Tm phosphor (wherein Ln is La or Gd, and X is Cl or Br), a ZnS:Ag phosphor, a $BaSO_4:Eu^{2+}$ phosphor and a $(Ba, Sr)SO_4:Eu^{2+}$ phosphor provide intensifying screens having high sharpness, and they are particularly recommended also for the intensifying screens of the present invention. Among them, a $CaWO_4$ phosphor and a LnOX:Tm phosphor are most preferred for the intensifying screen of the present invention.

As the colorant used to color at least one of the fluorescent and protective layers of the intensifying screen of the present invention, there may be employed those capable of efficiently absorbing lights of longer wave length components among the emitted lights of the blue emitting phosphor, namely, various dyestuffs or pigments of violet, red, orange or yellow type having the main peaks of the absorption spectra in a wave length region of from 400 to 600 nm. However, it is preferred to use dyestuffs, since it is thereby possible to obtain uniform coloring. It is particularly preferred to employ oil-soluble dyestuffs, for instance, violet dyestuffs such as Solvent Violet 31, 32 or 33, red dyestuffs such as Solvent Red 152, 155, 176 or 177, orange dyestuffs such as Solvent Orange 63, 68, 71 or 78, and yellow dyestuffs such as Solvent Yellow 105, 112 or 113, since they have excellent compatibility with the binder resin in the fluorescent layer or with an organic solvent in the coating dispersion of the phosphor. Further, from the viewpoint of improving the sharpness, it is preferred to employ violet or red dyestuffs having the main peaks of the absorption spectra in a wave length region of from 480 to 580 nm.

The degree of the coloring of the fluorescent layer and/or the protective layer with the colorant, may be varied by selecting the type and the amount of the colorant used. In the intensifying screen of the present invention, if the coloring degree is small, the improvement in the sharpness is little although the Z5 deterioration in the speed of the intensifying screen is little. On the other hand, if the coloring degree is too high, the deterioration of the speed will be substantial although the sharpness improves. Therefore, from the practical point of view, it is preferred that the coloring degree of at least one of the fluorescent and protective layers is such that when a comparison is made between intensifying screens each having a fluorescent layer of the same phosphor in the same coating amount by weight, the photographic sensitivity (speed) in the case where at least one of the fluorescent and protective layers is colored, is within a range of from 95 to 50% of the photographic sensitivity in the case where neither the fluorescent layer nor the protective layer is colored.

Table 1 shows the measured values of the speed, sharpness and granularity of the intensifying screens (from No. 1 to No. 6) wherein the fluorescent layers composed of a $CaWO_4$ phosphor were colored with various dyestuffs, as compared with the respective values of the intensifying screen (R) wherein the fluorescent layer was not colored at all. The speed of each intensifying screen (No. 1–No. 6) wherein the fluorescent layer was colored, was adjusted to be substantially equal to the speed of the intensifying screen (R) wherein the fluorescent layer was not colored, by adjusting the amount of the dyestuff to be incorporated to the fluorescent layer.

TABLE 1

| Intensifying screen | Dyestuff used | Wave length of the main absorption peak of the dyestuff | Amount of the coated phosphor | Speed | Sharpness | Granularity |
|---|---|---|---|---|---|---|
| No. 1 | Solvent Yellow 114 | 450 nm | 50 mg/cm$^2$ | 100 | 99 | ○ |
| 2 | Solvent Orange 68 | 480 nm | 50 mg/cm$^2$ | 99 | 103 | ○ |
| 3 | Solvent Orange 71 | 510 nm | 50 mg/cm$^2$ | 101 | 104 | ○ |
| 4 | Solvent Violet 32 | 540 nm | 50 mg/cm$^2$ | 101 | 106 | ◎ |
| 5 | Solvent Blue 87 | 580 nm | 50 mg/cm$^2$ | 100 | 103 | ○ |
| 6 | Solvent Green 20 | 610 nm | 50 mg/cm$^2$ | 101 | 98 | ○ |
| R | — | — | 40 mg/cm$^2$ | 100 | 100 | Δ |

Note 1: The speed, sharpness and granularity are represented by the relative values obtained by using a regular film and irradiating X-rays generated at the X-ray tube voltage of 80 kV and passed through a water-phantom having a thickness of 10 cm.
Note 2: Sharpness is a relative value of the MTF value at a spatial frequency of 2 lines/mm.
Note 3: The granularity was evaluated by the observation with naked eyes. The granularity deteriorated in the order of ◎, ○ and Δ.

It is evident from Table 1 that when intensifying screens have substantially the same speed wherein a $CaWO_4$ phosphor was used as the blue emitting phosphor, there is a substantial difference in the sharpness of the intensifying screens depending upon the absorption wave length of the colorant (dyestuff) used. When the colorant having the main peak of the absorption spectrum in a wave length region of from 450 to 600 nm is used, the sharpness is higher than the conventional intensifying screen wherein no colorant is used. Particularly when the intensifying screen is colored with a colorant having the main peak of the absorption spectrum in the vicinity of from 480 to 580 nm, the sharpness is remarkably improved. Further, in a case where a $BaSO_4:Eu^{2+}$ phosphor which has the peak of the emission spectrum in a further shorter wave length region than the $CaWO_4$ phosphor, is used as the blue emitting phosphor, even when a colorant having the main peak of the absorption spectrum in a wave length range of at least 400 nm is used, the sharpness of the intensifying screen thereby obtained will be higher than the intensifying screen which has the same speed and in which the fluorescent layer and/or the protective layer is not colored. Thus, the type of the colorant may vary depending upon the type of the blue emitting phosphor used. However, in the intensifying screen of the present invention, it is preferred to employ, as the coloring agent, a colorant having the main peak of the absorption spectrum in a wave length range of from 400 to 600 nm, more preferably from 480 to 580 nm, most preferably from 510 to 560 nm.

Further, it is also evident from Table 1 that by coloring the fluorescent layer with a colorant having a specific absorption spectrum distribution, not only the sharpness of the intensifying screen, but also the granularity of the intensifying screen is substantially improved.

It has been confirmed further that even in the case of an intensifying screen wherein a blue emitting phosphor other than $CaWO_4$ is used, it is possible to obtain high sharpness and improved granularity by coloring at least one of the fluorescent and protective layers with a colorant having the specific absorption spectrum distribution.

Referring to FIG. 1, curve A of solid line shows an emission spectrum of an intensifying screen of the present invention wherein a fluorescent layer composed of a $CaWO_4$ phosphor was colored with a violet dyestuff Solvent Violet 32, when X-rays were irradiated thereto. Likewise, curve B of dotted line shows an emission spectrum of a conventional intensifying screen having a fluorescent layer composed of a $CaWO_4$ phosphor wherein the fluorescent layer and the protective layer are not colored, when X-rays were irradiated thereto. It is evident from FIG. 1 that by coloring the fluorescent layer of the intensifying screen with Solvent Violet 32, lights of the longer wave length components of the emission lights of the blue emitting phosphor $CaWO_4$ are preferentially absorbed. For X-ray radiography, it is common to use two sheets of intensifying screens together with one sheet of film sandwiched therebetween and having an emulsion layer on each side. Lights emitted from one of the intensifying screens exposes the emulsion layer of the film which is in contact with that intensifying screen. A part of the emitted lights is likely to pass through the film and expose the emulsion layer of the film which is in contact with the other intensifying screen (which is so called "cross over effect"). The sharpness of intensifying screens deteriorates by this cross over effect. The reason why the intensifying screen of the present invention wherein the fluorescent layer and/or the protective layer is colored with a colorant capable of selectively absorbing lights of a certain specific wave length range, has superior sharpness to the conventional intensifying screens, is that the longer wave length components of the lights emitted from the blue emitting phosphor, which contribute substantially to the cross over effect, are reduced by the colorant.

Now, the present invention will be described in further detail with reference to Examples. However, it should be understood that the present invention is by no means restricted to these specific Examples.

EXAMPLE 1

Figure 2:
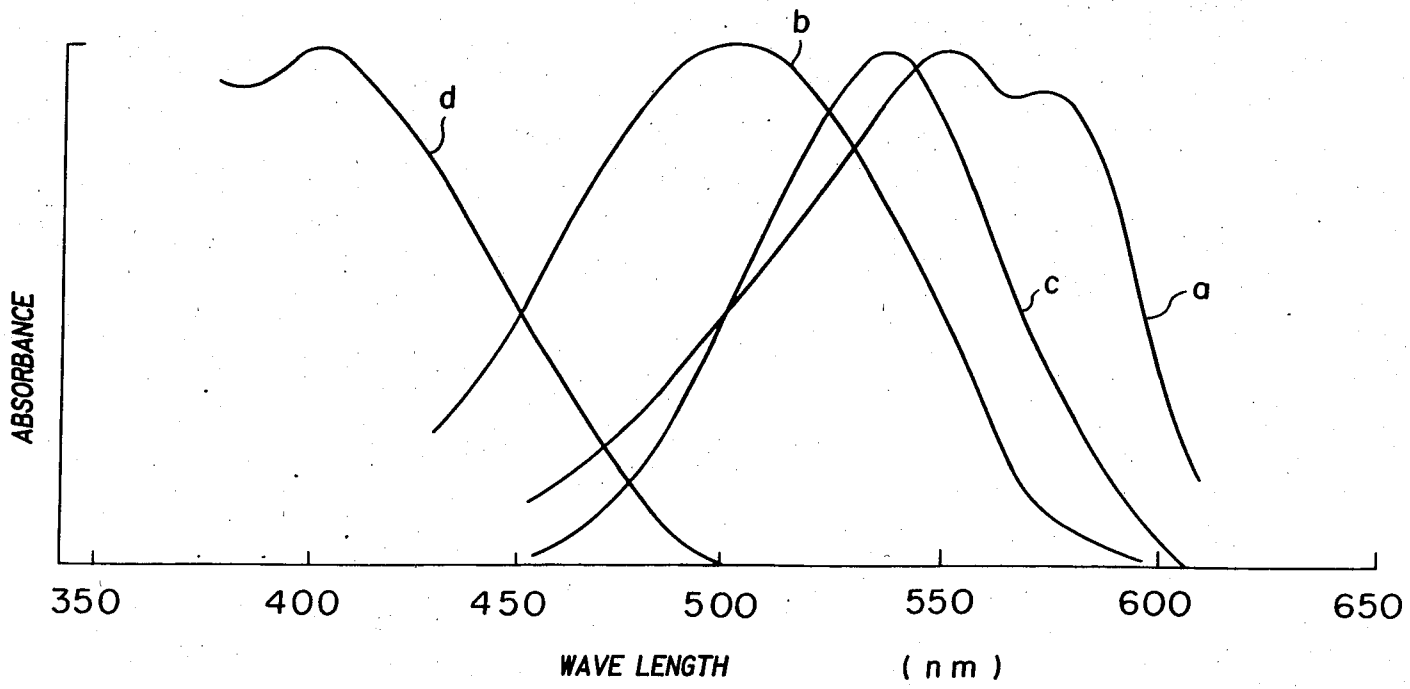
FIG. 2 is a graph illustrating the absorption spectrum of the colorant (as measured in the form of a solution) to be used for the intensifying screen of the present invention.

Solvent Violet 32 (Diaresin Violet A, manufactured by Mitsubishi Chemical Industries Co., Ltd.) having an absorption spectrum distribution as represented by curve a in FIG. 2, was added to a mixture of a $CaWO_4$ phosphor and a binder resin composed of a vinyl chloride-vinyl acetate copolymer, and the mixture was thoroughly stirred to obtain a coating dispersion of the phosphor. The amount of Solvent Violet 32 was adjusted so that the photographic sensitivity of the intensifying screen would be 80% of the photographic sensitivity of the intensifying screen prepared in the same manner without the addition of Solvent Violet 32. The coating dispersion of the phosphor thus obtained was applied by a knife coater onto a support made of polyethylene terephthalate, so that the coating weight of the phosphor after drying would be about 50 mg/cm$^2$. The coated dispersion was dried to form a fluorescent layer. Then, onto this fluorescent layer, a solution of acetyl cellulose was applied by a knife coater so that the layer thickness after drying would be about 10 $\mu$m, and the coated layer was dried to form a transparent protective layer of acetyl cellulose. Thus, an intensifying screen (I) wherein only the fluorescent layer was colored violet, was obtained.

For the purpose of comparison, an intensifying screen (R') wherein neither the fluorescent layer nor the protective layer is colored, was prepared in the same manner as in the case of the intensifying screen (I) except that no Solvent Violet 32 was added to the coating dispersion of the phosphor, and the coating dispersion of the phosphor was applied onto the support so that the coating weight of the phosphor after drying would be 40 mg/cm$^2$.

The intensifying screen (I) thus prepared was used in combination with a regular type X-ray film, whereby it was found that the photographic sensitivity was substantially equal to that of the intensifying screen (R') and the MTF value representing the sharpness was about 1.06 times that of the intensifying screen (R'), thus indicating a remarkable improvement in the sharpness. From the observation with naked eyes, the granularity of the intensifying screen (I) was superior to that of the intensifying screen (R').

EXAMPLE 2

An intensifying screen (II) wherein only the fluorescent layer was colored red, was prepared in the same manner as in the case of the intensifying screen (I) in Example 1 except that Solvent Orange 71 (Diaresin Red Z, manufactured by Mitsubishi Chemical Industries Co., Ltd.) having an absorption spectrum distribution represented by curve b in FIG. 2, was used as a dyestuff instead of Solvent Violet 32.

The intensifying screen (II) thus prepared was used in combination with a regular type X-ray film; whereby it was found that the photographic sensitivity was substantially equal to that of an intensifying screen (R') of Example 1 wherein neither the fluorescent layer nor the protective layer was colored, and the MTF value representing the sharpness was about 1.04 times that of the intensifying screen (R'), thus indicating a remarkable improvement in the sharpness. From the observation with naked eyes, the granularity of the intensifying screen (II) was superior to that of the intensifying screen (R').

EXAMPLE 3

A $CaWO_4$ phosphor was mixed with a binder comprising nitrocellulose and a solvent, and the mixture was thoroughly stirred to obtain a coating dispersion of the phosphor. The coating dispersion of the phosphor was applied by a knife coater onto a support made of polyethylene terephthalate so that the coating weight of the phosphor after drying would be 50 mg/cm$^2$. The applied coating dispersion was dried to form a fluorescent layer.

Solvent Violet 32 (Diaresin Violet A manufactured by Mitsubishi Chemical Industries Co. Ltd.) having an absorption spectrum distribution represented by curve a in FIG. 2 was mixed to an acetyl cellulose solution, and the mixture was thoroughly stirred and then applied by a knife coater onto the fluorescent layer prepared as above, so that the layer thickness after drying would be about 10 $\mu$m. The coated mixture was dried to form a protective layer. Thus, an intensifying screen (III) wherein only the protective layer is colored violet, was prepared. The amount of Solvent Violet 32 added to the acetyl cellulose solution for the formation of the protective layer, was adjusted so that the photographic sensitivity of the intensifying screen finally obtained would be about 80% of the photographic sensitivity of the intensifying screen prepared in the same manner without the addition of Solvent Violet 32.

The intensifying screen (III) thus prepared was used in combination with a regular type X-ray film, whereby it was found that the photographic sensitivity was substantially equal to that of the intensifying screen (R') of Example 1 wherein neither the fluorescent layer nor the protective layer was colored, and the MTF value representing the sharpness was about 1.05 times that of the intensifying screen (R'), thus indicating a remarkable improvement in the sharpness. From the observation with naked eyes, the granularity of the intensifying screen (III) was superior to that of the intensifying screen (R').

EXAMPLE 4

An intensifying screen wherein neither the fluorescent layer nor the protective layer was colored, was prepared in the same manner as in the case of the intensifying screen (R') of Example 1 except that the coating solution of the phosphor was applied onto the support so that the coating weight of the phosphor after drying would be 50 mg/cm$^2$. Then, the intensifying screen thus prepared was dipped in a solution of rhodamine B having an absorption spectrum distribution represented by curve c in FIG. 2, and then left to stand for a predetermined period of time, and then it was withdrawn from the solution, washed with water and dried to obtain an intensifying screen (IV) wherein only the protective layer was colored pink. The degree of the coloring of the protective layer with rhodamine B was adjusted by controlling the concentration of the rhodamine B solution and the dipping time so that the photographic sensitivity of the intensifying screen finally obtained would be lower by about 20% than the intensifying screen wherein the protective layer was not colored.

The intensifying screen (IV) thus obtained was used in combination with a regular type X-ray film, whereby it was found that the photographic sensitivity was substantially equal to that of the intensifying screen (R') of Example 1 wherein neither the fluorescent layer nor the protective layer was colored, and the MTF value representing the sharpness was about 1.04 times that of the intensifying screen (R'), thus indicating an improvement in the sharpness. From the observation with naked eyes, the granularity of the intensifying screen (IV) was superior to the intensifying screen (R').

EXAMPLE 5

An intensifying screen (V) wherein the fluorescent layer was colored yellow, was prepared in the same manner as in the case of the intensifying screen (I) of Example 1 except that a (Ba, Sr)$SO_4$:$Eu^{2+}$ phosphor was used instead of the $CaWO_4$ phosphor and Solvent Yellow 103 (Diaresin Yellow C manufactured by Mitsubishi Chemical Industries Co., Ltd.) having an absorption spectrum distribution represented by curve d in FIG. 2 was mixed to the dispersion of a mixture of said phosphor and a binder resin composed of a vinyl chloride-vinyl acetate copolymer.

For the purpose of comparison, an intensifying screen (R'') wherein neither the fluorescent layer nor the protective layer was colored, was prepared in the same manner as in the case of the intensifying screen (R') of Example 1 except that a (Ba, Sr)$SO_4$:$Eu^{2+}$ phosphor was used instead of the $CaWO_4$ phosphor.

The intensifying screen (V) thus prepared was used in combination with a regular type X-ray film, whereby it was found that the photographic sensitivity was substantially equal to that of the intensifying screen (R''), and the MTF value representing sharpness was about 1.04 times that of the intensifying screen (R''), thus indicating an improvement in the sharpness. From the observation with naked eyes, the granularity of the intensifying screen (V) was superior to that of the intensifying screen (R'').

EXAMPLE 6

An intensifying screen (VI) wherein the fluorescent layer was colored red, was prepared in the same manner as in the case of the intensifying screen (I) of Example 1 except that a LaOBr:Tm phosphor was used instead of the $CaWO_4$ phosphor and Solvent Orange 71 (Diaresin Red Z manufactured by Mitsubishi Chemical Industries Co., Ltd.) having an absorption spectrum distribution represented by curve b in FIG. 2 was mixed to the dispersion of a mixture of said phosphor and a binder resin composed of a vinyl chloride-vinyl acetate copolymer.

For the purpose of comparison, an intensifying screen (R''') wherein neither the fluorescent layer nor the protective layer was colored, was prepared in the same manner as in the case of the intensifying screen (R') of Example 1 except that a LaOBr:Tm phosphor was used instead of the $CaWO_4$ phosphor.

The intensifying screen (VI) thus prepared was used in combination with a regular type X-ray film, whereby it was found that the photographic sensitivity was substantially equal to that of the intensifying screen (R'''), and the MTF value representing sharpness was about 1.06 times that of the intensifying screen (R'''), thus indicating an improvement in the sharpness. From the observation with naked eyes, the granularity of the intensifying screen (VI) was superior to that of the intensifying screen (R''').

As described in the foregoing, according to the present invention, it is possible not only to remarkably improve the sharpness of the intensifying screen with a fluorescent layer composed essentially of a blue emitting phosphor such as $CaWO_4$, but also to improve the granularity, by coloring at least one of the fluorescent and protective layers with a colorant having the main peak of the absorption spectrum in the wave length region of from 400 to 600 nm and thus letting the colorant absorb the longer wave length components of the lights emitted from the blue emitting phosphor.

What is claimed is:

1. An intensifying screen, consisting of: a support, a fluorescent layer on the support and a protective layer on the fluorescent layer, wherein the fluorescent layer is composed essentially of a blue light emitting phosphor selected from the group consisting of (I) a $M^{II}WO_4$ phosphor, wherein $M^{II}$ is at least one of Mg, Ca, Zn and Cd, (2) a $CaWO_4$ phosphor, (3) a $BaSO_4$:Pb phosphor, (4) a $BaSO_4:Eu^{2+}$ phosphor, (5) a (Ba, Sr)$SO_4:Eu^{2+}$ phosphor, (6) a $MeF_2.pMe'X_2.qKX'.rMe''SO_4:mEu^{2+}$, $nTb^{3+}$ phosphor, wherein Me is at least one of Mg, Ca, Sr and Ba, each of Me' and Me'' is at least one of Ca, Sr and Ba, each of X and X' is at least one of Cl and Br, and p, q, r, m and n are numbers which satisfy the conditions of $0.80 \leqq p \leqq 1.5$, $0 \leqq q \leqq 2.0$, $0 \leqq r \leqq 1.0$, $0.001 \leqq m \leqq 0.10$ and $0 \leqq n \leqq 0.05$, respectively, provided $q+r \neq 0$, (7) a LnOX:Tm phosphor, wherein Ln is La or Gd, and X is Cl or Br, (8) a $Ln(Ta_{1-x}, Nb_x)O_4$:Tm phosphor, wherein Ln is at least one of La, Y, Gd and Lu, and $0 \leqq x \leqq 0.3$, (9) a $Y_2O_2S$:Tb phosphor, (10) a CsI:Na phosphor, (11) a CsI:Tl phosphor, (12) a NaI phosphor, (13) a ZnS:Ag phosphor and (14) a $HfP_2O_7$:Cu phosphor, and wherein at least one of the fluorescent and protective layers is colored with a colorant which has a main absorption peak at a wavelength in the region of 400 to 600 nm.

2. The intensifying screen according to claim 1, wherein the colorant has the main peak of its absorption spectrum in the wavelength region of from 480 to 580 nm.

3. The intensifying screen according to claim 1, wherein the colorant has the main peak of its absorption spectrum in the wavelength region of from 510 to 560 nm.

4. The intensifying screen according to claim 1, wherein the light emitting phosphor is at least one phosphor selected from the group consisting of (1) a $CaWO_4$ phosphor, (2) a LnOX:Tm phosphor wherein Ln is La or Gd, and X is Cl or Br, (3) a ZnS:Ag phosphor, (4) a $BaSO_4:Eu^{2+}$ phosphor and (5) a (Ba, Sr)$SO_4:Eu^{2+}$ phosphor.

5. The intensifying screen according to claim 1, wherein the light emitting phosphor is a $CaWO_4$ phosphor.

6. The intensifying screen according to claim 1, wherein the light emitting phosphor is a LnOX:Tm phosphor wherein Ln is La or Gd, and X is Cl or Br.

7. The intensifying screen according to claim 1, wherein the colorant is a dyestuff.

8. The intensifying screen according to claim 7, wherein the dyestuff is an oil color.

9. The intensifying screen according to claim 1, which has a photographic sensitivity at a level of from 95 to 50% of the photographic sensitivity of an intensifying screen not colored with the above-mentioned colorant.

* * * * *